United States Patent [19]

Hashimoto

[11] Patent Number: 4,890,080

[45] Date of Patent: Dec. 26, 1989

[54] ELECTROMAGNETIC RELAY WITH AN OPERATION INDICATING MEMBER

[75] Inventor: Hiroshi Hashimoto, Kashima, Japan

[73] Assignee: Omron Tateisi Electronics Company, Kyoto, Japan

[21] Appl. No.: 239,534

[22] Filed: Sep. 1, 1988

[30] Foreign Application Priority Data

Sep. 4, 1987 [JP] Japan ..... 62-135938[U]

[51] Int. Cl.[4] ..... H01H 73/12; H01H 75/00; H01H 77/00

[52] U.S. Cl. ..... 335/17

[58] Field of Search ..... 335/17, 156; 340/815.05, 815.29

[56] References Cited

U.S. PATENT DOCUMENTS 4,771,253 9/1988 Sasaki et al. ..... 335/17

FOREIGN PATENT DOCUMENTS 1137265 12/1968 United Kingdom ..... 335/17

*Primary Examiner*—H. Broome

*Attorney, Agent, or Firm*—Foley & Lardner, Schwartz, Jeffery, Schwaab, Mack, Blumenthal & Evans

[57] ABSTRACT

An electromagnetic relay with an operation indicating member comprises a housing including a base and a case having a window, a switching unit including an electromagnet, terminals disposed on the base, contacts fixed to the terminals, and an operation indicating member. Terminals and contacts are heated by arc discharge during switching action of the relay and by current flowing through the terminals. The indicating member is, however, not heated because the indicating member is disposed at a location away from the heated components. The indicating member is thus prevented from being deformed by the heat generated from the contacts. Consequently, the indicating member can invariably be seen through a window in the case.

4 Claims, 2 Drawing Sheets

ELECTROMAGNETIC RELAY WITH AN OPERATION INDICATING MEMBER

BACKGROUND OF THE INVENTION

1. Field of the Invention

This invention relates to an electromagnetic relay, and more particularly, to an electromagnetic relay which includes a member for indicating the operation of the relay.

2. Related Art

A conventional relay with an operation indicating member includes a housing formed by a case and a base. The case has a window through which operation of the relay can be seen. An electromagnet fixed to a yoke is attached to the base through the yoke using a rivet.

A movable iron member is pivotally mounted on the tip of the yoke so that the iron member can make contact with an iron core of the electromagnet. The movable iron member includes an electrical insulator support to which a movable member is fixed. The movable member carries a movable contact on the tip thereof. A terminal fixed to the base includes a stationary contact, and another terminal fixed to the base also includes a stationary contact. The two stationary contacts are horizontally opposite to each other. The movable member is arranged so that the movable contact can be disposed between the two stationary contacts. The movable contact makes contact with one of the stationary contacts when the electromagnet is in an inactivated condition.

A plate for indicating operation of the relay (operation indicating plate) is vertically provided between the insulator support and the case. A fulcrum at the lower portion of the plate rests on the base and is tightly sandwiched between a first of the terminals and the case. A locking projection horizontally fixed on the shank of the plate engages the insulator support. The operation indicating plate is arranged so that the tip thereof cannot be seen through the window of the case when the electromagnet is in the inactivated condition.

When the electromagnet is energized, the movable iron member is attracted to the iron core of the electromagnet. The movable contact accordingly breaks contact with the first of the stationary contacts, and comes into contact with the other. At the same time, the operation indicating plate is biased to a predetermined position, and the tip of the indicating plate thus can be seen through the window. Consequently, the operation of the relay can be checked.

However, since the indicating plate is placed near the contacts, it is easily heated and deformed by the heat of the arc discharge between the movable contact and the stationary contacts. In addition, current flowing through the terminals causes the terminal to be heated. The heat of the terminals also causes the deformation of the fulcrum. The deformed fulcrum renders the normal movement of the indicating plate difficult, and the indicating plate thus fails to move to the predetermined position. The tip of the indicating plate therefore cannot be seen through the window of the case. Consequently, the operation of the relay cannot be checked.

In the foregoing relay, the rivet is horizontally moved to adjust the contact pressure. However, moving the rivet to an undesired position results in a malfunction of the indicating plate or in the indicating plate being only loosely fixed within the device.

SUMMARY OF THE INVENTION

It is, therefore, an object of the present invention to provide an electromagnetic relay with an operation indicating member which is not adversely affected by heat from the arc discharge between the movable and the stationary contacts.

According to this invention, there is provided an electromagnetic relay with an operation indicating member. The relay includes (1) a housing having a base and a case including a window therein, (2) switching means housed in the case, the switching means including an electromagnet, terminals disposed on the base and contacts fixed on the terminals, wherein the switching means operates according to one of activation and inactivation of the electromagnet, and (3) an indicating member supported by the case for indicating an operation of the switching means through the window in the case.

BRIEF DESCRIPTION OF THE DRAWINGS

The above and other objects, advantages and features of this invention will be more fully understood when considered in conjunction with the following FIGS., wherein.

DETAILED DESCRIPTION OF THE PREFERRED EMBODIMENTS

Figure 1:
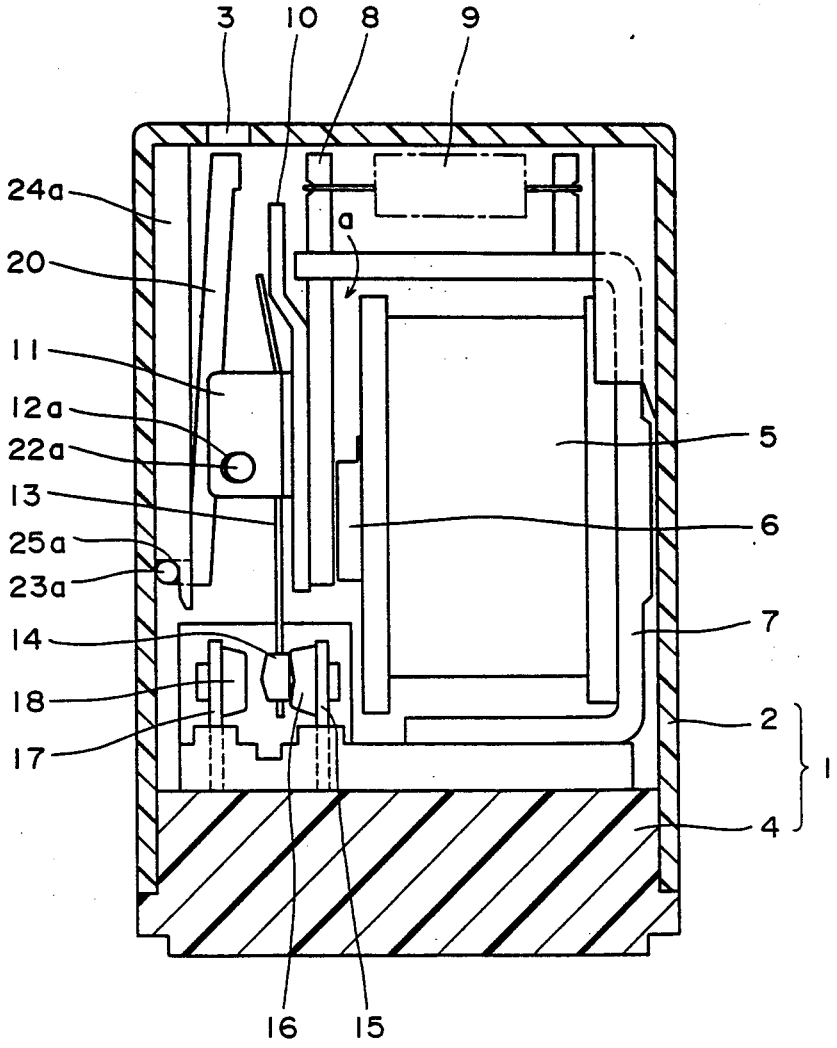
FIG. 1 is a longitudinal sectional view of a preferred embodiment of the invention.
Figure 2:
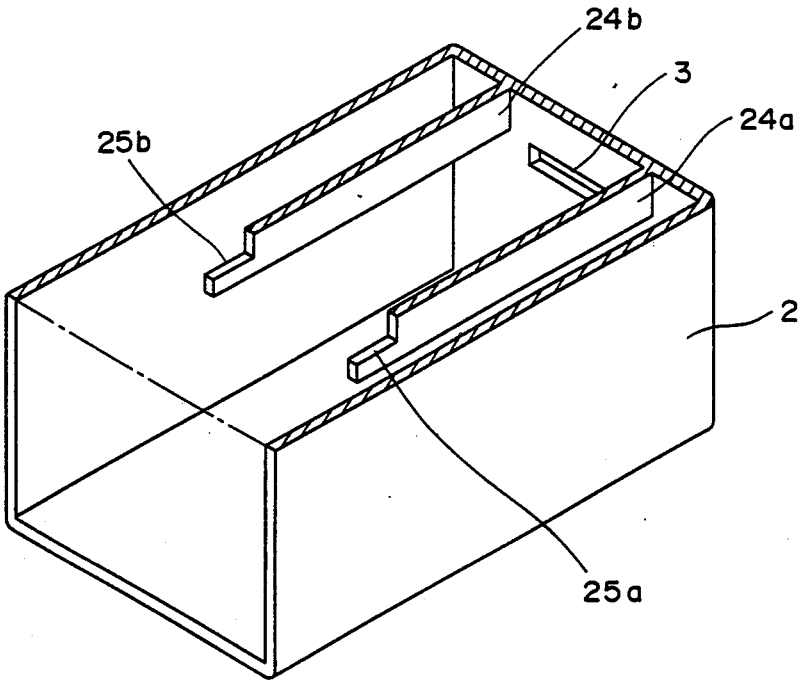
FIG. 2 is a perspective view of a case shown in FIG. 1 with one side thereof cut away.

FIG. 1 shows an electromagnetic relay with an operation indicating member. A housing 1 includes a case 2 and a base 4. Case 2 has a window 3 in the top thereof and a pair of supports 24*a* and 24*b*. Supports 24*a* and 24*b* include engaging portions 25*a* and 25*b*, respectively. An electromagnet 5 is fixed to a yoke 7 which is in turn fixed to the base 4 by rivets (not shown) through a yoke 7. A movable iron member 8 is pivotally supported on the tip of yoke 7 so that member 8 can make contact with an iron core 6 of electromagnet 5. When electromagnet 5 is in the inactivated condition, iron member 8 is biased by a spring 9 in the direction shown by arrow "a". An electrical insulator frame 11 is coupled to iron member 8 through a spacer 10. An electrical conductive movable member 13 includes a movable contact !4 on the tip thereof and is mounted on frame 11. Terminals 15 and 17 are provided on base 4. Terminal 15 has a stationary contact 16, and terminal 17 has a stationary contact 18, the contacts being horizontally opposite to each other. Movable member 13 is arranged so that movable contact 14 can be disposed between the stationary contacts 16 and 18. Movable member 13 is electrically connected to another terminal (not shown) via a lead (also not shown).

Figure 3:
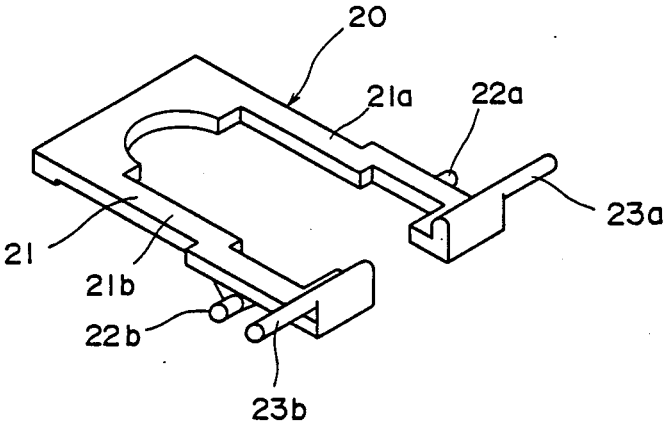
FIG. 3 is a perspective view of an operation indicating member shown in FIG. 2.

A plate for indicating operation of the relay (an operation indicating plate 20) is coupled to frame 11. As shown in Fig. 3, plate 20 includes a generally U-shaped body 21 which has a pair of arm portions 21*a* and 21*b*. Arm portion 21*a* has a shaft 22*a* thereon, and a fulcrum bar 23*a* on the tip thereof. Arm portion 21*b* carries a shaft 22*b* and a fulcrum bar 23*b* on the tip thereof. Shaft 22*a* and bar 23*a* are opposite shaft 22*b* and bar 23*b*, respectively. Shaft 22*a* is inserted into a hole 12*a* provided in one side wall of frame 11. Since hole 12*a* is slightly longer than it is wide in the horizontal direction, there is a clearance between shaft 22*a* and hole 12*a*. Shaft 22*b* is also inserted into a hole, not shown, provided in an opposite wall of frame 11. There is also provided a similar clearance between shaft 22*b* and the hole.

As shown in FIG. 1, fulcrum bar 23*a* is rotatably sandwiched between engaging portion 25*a* and a side wall on case 2, while bar 23*a* is also rotatably sandwiched between engaging portion 25*b* and case 2, although this is not shown. Plate 20 can pivotally move around the pair of fulcrums 23*a* and 23*b*. Fulcrums 23*a* and 23*b* engage the engaging portions 25*a* and 25*b*, respectively, and are thereby positioned when case 2 is fixed to base 4.

The operation of the relay is described below. When electromagnet 5 is in the inactivated condition, movable iron member 8 is biased by spring 9 into the arrow "a" direction. Movable contact 14 accordingly makes contact with stationary contact 18. Plate 20 is forced toward the side wall of case 2 via frame 11, while the tip of the plate moves away from window 3. The tip consequently cannot be seen through window 3.

On the other hand, when electromagnet 5 is activated, iron member 8 is attracted to iron core 6. Movable contact 14 accordingly breaks contact with contact 18 and makes contact with stationary contact 16. Plate 20 rotates around fulcrum 23*a* and 23*b* and moves to the position shown in FIG. 1. The tip of plate 20 thus comes into view through window 3.

Terminals 15 and 17, contacts 14, 16 and 18 are heated by arc discharge during the switching action of the relay and by current flowing through terminals 15 and 17, and movable member 13. Plate 20, however, is not heated because plate 20 is disposed at a location away from the heated terminals 15 and 17, contacts 14, 16 and 18, and movable member 13. Plate 20 is thus prevented from being deformed by heat. On the other hand, frame 11 is displaced when electromagnet 5 and yoke 7 are moved to adjust the contact pressure. However, the clearance between shaft 22*a* and hole 12*a* prevents plate 20 from deviating from the normal position together with the clearance between shaft 22*b* and the hole. Consequently, plate 20 can invariably be seen.

The above description and the accompanying drawings are merely illustrative of the application of the principles of the present invention and are not limiting. Numerous other arrangements which employ the principles of the invention and which fall within its spirit and scope may be readily devised by those skilled in the art. Accordingly, the invention is not limited by the foregoing description, but only limited by the scope of the appended claims.

What is claimed is:

1. An electromagnetic relay having an operation indicating member, comprising:

(a) a housing formed by a base and a case thereon;
(b) a window in said case;
(c) switching means in said housing, said switching means including an electromagnet, terminals on said base, contacts fixed on said terminals and a movable contact movable between the stationary contacts by the electromagnet;
(d) an indicating member supported by said case for indicating operation of said switching means through said window;
(e) a supporting member connected to said electromagnet for movably supporting said indicating member; and
(f) a movable member connected to said supporting member for bearing said movable contact.

2. An electromagnetic relay having an operation indicating member, comprising:

(a) a housing formed by a base and a case thereof;
(b) a window in said case;
(c) switching means in said housing, said switching means including an electromagnet, terminals on said base and contracts fixed on said terminals;
(d) an indicating member supported by said case for indicating operation of said switching means through said window; and
(e) a pair of support means for pivotally supporting said indicating member;

wherein each of said support means includes an engaging portion, and said indicating member includes a pair of arm portions, each of said arm portions having a fulcrum bar, wherein said engaging portion engages said fulcrum bar to pivotally support said indicating member around said fulcrum bar.

3. An electromagnetic relay having an operation indicating member, comprising:

(a) a housing formed by a base and a case thereof;
(b) a window in said case;
(c) switching means in said housing, said switching means including an electromagnet, terminals on said base and contracts fixed on said terminals;
(d) an indicating member supported by said case for indicating operation of said switching means through said window; and
(e) a pair of support means for movably supporting said indicating member;

wherein said supporting member includes a pair of holes, and said indicating member includes a pair of shafts each of which is inserted into respective holes, wherein there is provided a clearance between said hole and shaft to allow free movement of said shaft in said hole without displacing said indicating member.

4. An electromagnetic relay, comprising:

(a) a housing having a base;
(b) an electromagnet positioned in said housing;
(c) a pair of stationary contacts mounted on said base;
(d) a movable contact movable between said stationary contacts by said electromagnet;
(e) a window in said housing substantially remote from said stationary and movable contacts;
(f) an operation indicating member supported by said housing and being movable by said electromagnet relative to said window;
(g) a supporting member connected to the electromagnet for moving said operation indicating member; and
(h) a movable member connected to said supporting member for bearing said movable contact, wherein heat from said contacts does not effect said operation indicating member.

* * * * *